US006263545B1

(12) United States Patent
Pinto

(10) Patent No.: US 6,263,545 B1
(45) Date of Patent: Jul. 24, 2001

(54) BATT FORMING APPARATUS

(76) Inventor: Akiva Pinto, 101 Verdae Blvd. PMB 328, Ste. 130, Greenville, SC (US) 29607-9300

( * ) Notice: Subject to any disclaimer, the term of this patent is extended or adjusted under 35 U.S.C. 154(b) by 0 days.

(21) Appl. No.: 09/505,922

(22) Filed: Feb. 17, 2000

(51) Int. Cl.[7] ..... D01B 1/00
(52) U.S. Cl. ..... 19/97.5; 19/65 A; 19/205
(58) Field of Search ..... 19/92, 97, 97.5, 19/90, 65 A, 105, 204, 205, 225, 300

(56) References Cited

U.S. PATENT DOCUMENTS

| | | | | |
|---|---|---|---|---|
| 4,045,091 | * | 8/1977 | Beneke | 19/105 |
| 4,240,180 | * | 12/1980 | Wood et al. | 19/105 |
| 4,301,572 | * | 11/1981 | Miyamoto | 19/97 |
| 4,387,486 | * | 6/1983 | Keller et al. | 19/105 |
| 4,394,789 | * | 7/1983 | Egerer | 19/97 |
| 4,403,374 | * | 9/1983 | Wood | 19/105 |
| 4,520,530 | * | 6/1985 | Pinto | 19/105 |
| 4,574,433 | * | 3/1986 | Brunnschweiler | 19/105 |
| 4,657,444 | | 4/1987 | Pinto | 406/23 |
| 4,682,388 | * | 7/1987 | Pinto | 19/105 |
| 4,694,538 | | 9/1987 | Pinto et al. | 19/105 |
| 4,700,431 | * | 10/1987 | Artzt et al. | 19/105 |
| 4,709,451 | * | 12/1987 | Leifeld | 19/105 |
| 4,858,277 | * | 8/1989 | Pinto et al. | 19/205 |
| 5,156,743 | | 10/1992 | Moncrief | 210/671 |
| 5,343,597 | * | 9/1994 | Pinto et al. | 19/205 |
| 5,701,637 | * | 12/1997 | Graf | 19/114 |
| 5,950,282 | | 9/1999 | Pinto | 19/97 |

* cited by examiner

*Primary Examiner*—John J. Calvert
*Assistant Examiner*—Gary L. Welch
(74) *Attorney, Agent, or Firm*—Flint & Kim, P.A.

(57) ABSTRACT

An apparatus for forming a non-woven fiber baft of fibrous material which includes a housing connecting with a plurality of feed chutes which feed fibers from a plurality of sources into a mixing chamber. Feed rolls, adjacent each discharge end of the feed chutes, are driven at selected speeds to withdraw fibers from the feed chutes at selected rates. A combing roll within the mixing chamber acts to assist the fibers from the mixing chamber into a beater chamber where they are further blended and opened. From the beater chamber the fibers move into a batt forming chute where they are formed into a fiber batt. The batt forming chute includes a packing belt and a vibrating assembly each driven at selected speeds to compact the fibers into a fiber batt of desired density. Volume dependent controls within the batt forming chute act to control the rate of the feed rolls and the beater roll while weight or density dependent controls outside the batt forming chute act to control the rate of the packing belt and the vibrating assembly.

21 Claims, 1 Drawing Sheet

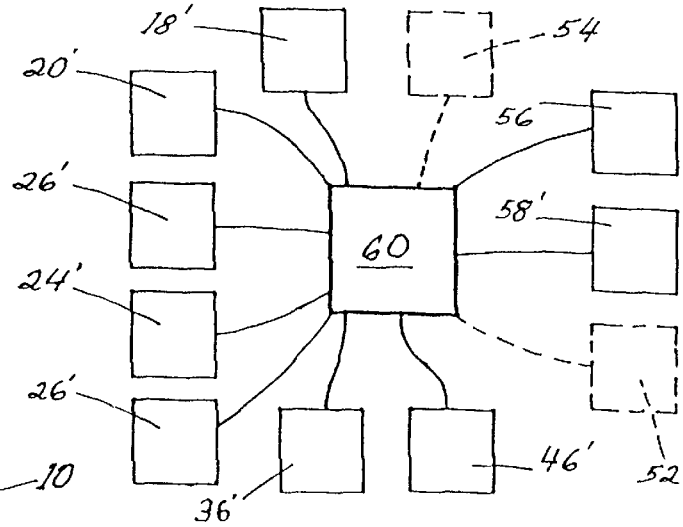
Fig. 3
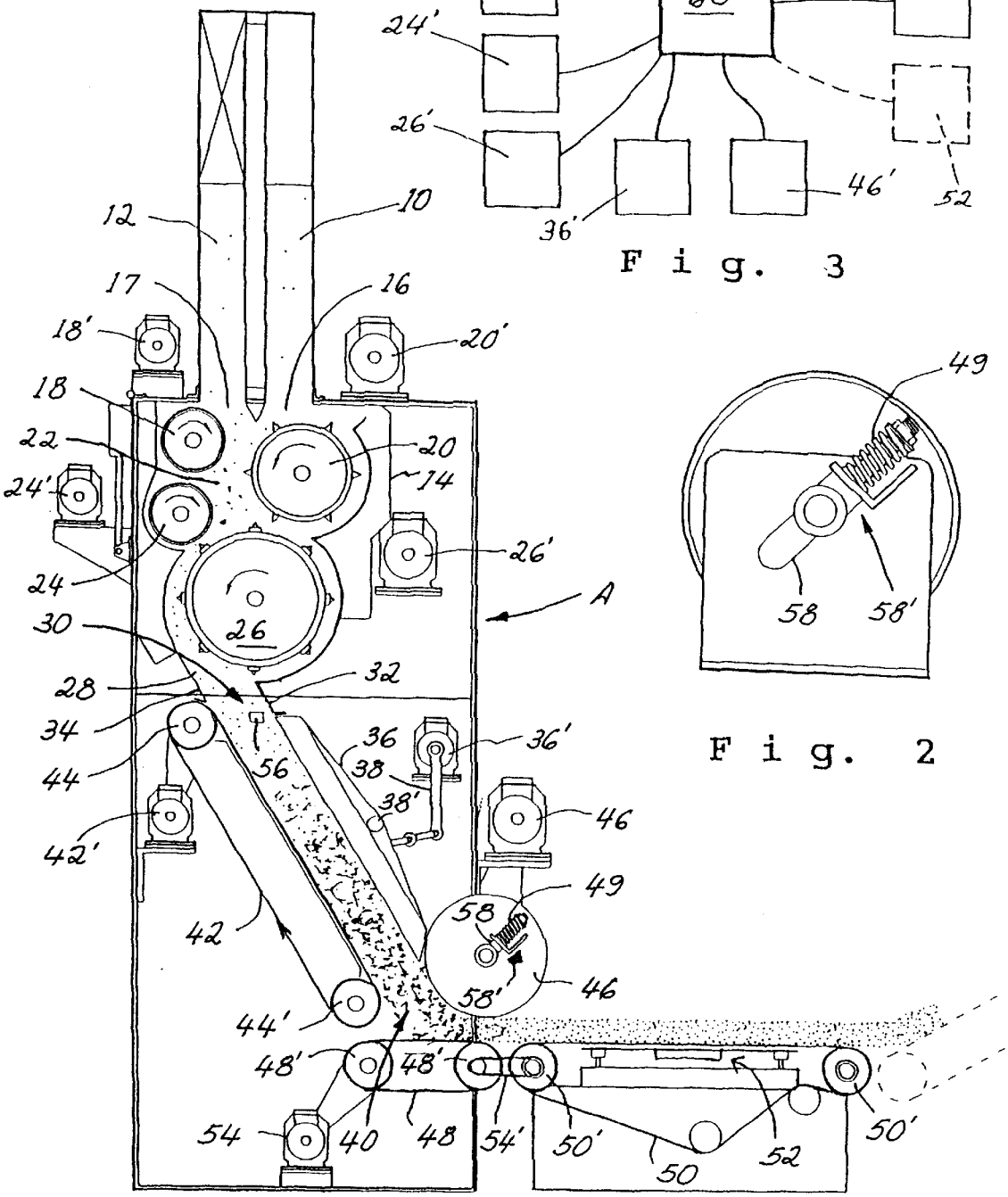
Fig. 1
Fig. 2

BATT FORMING APPARATUS

BACKGROUND OF THE INVENTION

Apparatus of this invention relates to fiber feeding, blending and fiber batt forming. The apparatus features controls for varying the rate of feed between multiple sources for varying the blending and feeding to control the density of the fiber batt being formed. The arrangement is an improvement over U.S. Pat. No. 5,950,282 issued Sep. 14, 1999, the disclosure of which is incorporated herein.

Fiber blending and fiber batt forming systems are well known in the industry. Various contemporary arrangements are shown in U.S. Pat. Nos. 4,694,538; 4,657,444; and 4,520,530. None of these patents teach the system of controlled blending and controlled fiber batt density forming as herein disclosed.

The invention has for an object a blending system which receives fibers from a plurality of sources at controlled rates.

Another object of the invention is an improved multi-source fiber feeding and blending system.

Another object of the invention is a controlled feed for delivery of fibers of a selected blend to a beater.

Another object of the invention is a fiber batt forming chute which provides a positive drive for movement of the fibers into a compacted fiber batt.

Another object of the invention is a fiber batt forming chute of a substantially constant size.

Another object of the invention is a control system responsive to sense fiber volume in the batt forming chute and being responsive to change the fiber volume to desired levels.

Another object of the invention is a variable speed positive feed for the fiber batt forming chute.

Another object of the invention is a control system which in response to fiber batt density sensings acts to bring about change of density in subsequent fiber batts being formed.

SUMMARY OF THE INVENTION

The instant invention is directed to an apparatus for forming a non-woven fiber batt of fibrous material. The apparatus includes a feed having a plurality of feed chutes for feeding fibers from a plurality of sources. The discharge ends of the feed chutes connect with a housing which includes a mixing chamber, a beater chamber and a fiber batt forming chute.

The mixing chamber includes a feed roll adjacent each discharge end of each feed chutes which withdraw the fibers from the feed chutes and deliver them into the mixing chamber. Preferably, the feed rolls are of different diameters. A combing roll within the mixing chamber acts to move the fibers from the mixing chamber onto a beater roll chamber which further blends and opens the fibers during delivery to the batt forming chute.

The system may provide independent drives for each of the feed rolls, the comber roll and the beater roll, which drives are capable of being controlled to drive each roll at selected peripheral speeds.

The feed rolls, the combing rolls and the beater rolls each have protruding teeth forming their outer surfaces. The teeth forming the surface of at least one of the rolls form a helical bite.

The system includes a control which is capable of causing each drive to drive it particular roll at selected RPM's.

The fiber batt forming apparatus of the invention includes a fiber batt forming chute which receives the mixed fibers from the beater roll and forms them into a fiber batt. The batt forming chute includes an upper and a lower wall, a delivery end and a receiving end. A packing belt extends from the vicinity of the receiving end to the vicinity of the delivery end and forms at least a portion of one of the upper and lower walls.

An independent drive is provided for driving the packing belt in the direction of the delivery end.

A vibrating plate is located in and forms at least a portion of the other of the upper and lower walls, preferable the upper wall. An independent drive is provided for driving the vibrating plate.

A compression roll is located adjacent the deliver end of the batt forming chute. The compression roll acts to further compress the fibers forming the fiber batt against a delivery surface during it exodus from the batt forming chute. The compression roll mounting structure permits movement of the compression roll relative to the delivery surface in dependence upon the density of the fiber batt emerging from the delivery end. A control which varies the operational speed of the drive of at least one of the packing belt and the vibrating plate responsive to the position of the compression roll is provided . The movement of the compression roll as controlled by the density of the fiber batt operates the control to vary the speed of at least the packing belt.

A conveyor receives the fiber batt emerging from the fiber batt forming chute and the compression roll. The conveyor including a scale for weighing the fiber batt during delivery to further processing. The scale is effective to signal a control which, in response to the signal, controls the operational speed of at least one of said packing belt and said vibrating plate.

The batt forming chute includes a sensor which detects an absence of fibers in the batt forming chute or an excess of fibers in the batt forming chute. The sensor is connected with at least one of the feed roll, the comber roll and the beater roll drives and is operative to selectively adjust the peripheral speed of each of these rolls in dependence upon these sensings.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 1 is a side view of the fiber feed, blending and fiber batt forming apparatus of the invention;

FIG. 2 is an exploded side view of the compression roll mounting structure; and, FIG. 3 is a block diagram of the control which maintains the roll drives at selected drive speeds in response to fiber quantity and fiber baft density.

DESCRIPTION OF A PREFERRED EMBODIMENT

Turning now to the drawings, a pair of feed chutes 10,12 are shown connecting with housing 14 formed within cabinet A. Preferably each feed chute 10,12 is connected with a fiber feed apparatus as disclosed in U.S. Pat. No. 5,950,282.

Fiber discharge openings 16, 17 are arranged in the upper surface of housing 14. Feed roll 18 is located adjacent opening 17 and rotates in a clockwise direction. Feed roll 20 is located adjacent opening 16 and rotates in a counter clockwise direction. Preferably, the diameter of feed roll 18, which is about 6 inches in diameter, is about half the diameter of feed roll 20.

Feed rolls 18 and 20 are driven by independent drive motors 18', 20' which are each controlled to selectively drive the feed rolls at selected RPM's. The speed selected is determined by sensors, to be discussed further on, which, in most instances, control feed rolls 18 and 20 to have the same peripheral speed. A median peripheral speed for feed rolls 18 and 20 is between 0 and 20 m/min. In cases where the fiber mixture from chutes 10 and 12 is to be varied, the peripheral speed between rollers 18 and 20 is adjusted as required.

The feed rolls deliver the fibers into mixing chamber 22 where they are further opened and blended. At the lower end of mixing chamber 22 there is located a combing roll 24 and a beater roll 26. Combing roll 24 along with feed roll 20 act to pick up fibers in the mixing chamber and wipe them onto the outer surface of the beater roll. The beater roll in turn acts to further open and blend the fibers as they are moved through the beater chamber during delivery into receiving end 28 of batt chute 30.

Comber roll 24 and beater roll 26 are driven by motors 24' and 26' at selected speeds.

The peripheral surfaces of feed rolls 18, 20, of comber roll 24 and of beater roll 26 are formed of pin like members of usual construction. Normally, the pins are arranged in parallel transverse rows, however in the case of at least feed roll 20, it has been found to be desirable to arrange the pin rows in a helical pattern. Such a pattern of teeth acts to more evenly wipe the fibers onto beater roll 26.

Batt forming chute 30 is of usual rectangular shape with an upper wall 32 and a lower wall 34 spaced by a pair of equal sized sides. Upper wall 32 includes a vibrating plate 36. Vibrating plate 36 extends across the width of upper wall 32 and lengthwise of batt forming chute 30 from adjacent the upper end of wall 32 to the end of batt forming chute 30. Vibrating plate 36 forms the upper surface of discharge or delivery end 40 of the batt forming chute. Vibrating plate 36 is driven in a rocking motion about pivot 38' by motor 36' through linkage 38. The structure of baft chute 30 maintains vibrating plate 36 is substantially fixed positioned relative to lower wall 34. Vibrating plate 36 acts to assist in the flow or movement of fibers fed through receiving end 28 toward and through delivery end 40.

Lower wall 34 carries packing belt 42 which extends over substantially its entire area . Packing belt 42 which is continuous, passes around roller 44 which is arranged near the upper end of lower wall 34 and around the roller 44' which is arranged at delivery end 40 of the batt forming chute. Motor 42' drives roller 44 and packing belt 42 in a clockwise direction. The packing belt acts to physically assist the movement of the fibers, which until this point are fed by gravity, down the packing chute forming the fiber batt of more evenly blended fibers in the lower portion of the batt forming chute.

Compression roll 46, which is driven by motor 46', acts to compress and draw the formed fiber batt out of delivery end 40 of the batt forming chute.

A conveyor belt 48, arranged adjacent delivery end 40 receives the fiber batt emerging from the delivery end. Conveyor belt 48, which passes around rollers 48', acts as a back wall against which compression roll 46 compresses the fiber batt and as a delivery belt for moving the formed fiber baft onto conveyor belt 50.

Conveyor belt 50 passes about rollers 50'. Motor 54 which connected with a roller 48' also drives conveyor belt 50 through drive belt 54'.

Mounted intermediate rollers 50' is a scale 52 which acts to weigh the fiber batt emerging from delivery end 40 as it is moved over conveyor belt 50. The weight of the formed fiber batt is sent to control 60 which calculates its density and compares this density to a norm.

Another method for determining the density of the fiber batt being formed is to mount compression roll 46 in slots 58 (FIG. 2)which are arranged at an incline relative to conveyor surface 48. Resilient members 49 urge compression roll 46 in the direction of the emerging fiber batt, further compressing it. Photoelectric sensor 58' is positioned along slot 58 and acts to determine the position of the compression roll within the slot. The position of compressor roll 46 in slot 58 is determined by the density of the fiber batt. The sensed position is sent to control 60 which calculates the density of the fiber batt and compares it to a norm.

Finally, the volume of fibers within batt forming chute 30 is determined by sensor 56 which is a ultrasonic sensor designed to deliver a first signal to control 60 when the fiber volume is insufficient and a second signal to control 60 when the fiber volume is in excess. Again such type sensors are well known in this environment.

Normally only one of the sensors 52 and 58' will be provided at any one time as their functions are duplistic. However, in certain instances, both may be desired.

Turning now to FIG. 3, a block diagram of the control system is shown. Control 60, which may be a computer, is connected with fiber volume sensor 56, compressor roll sensor 58' and/or scale sensor 52. Control 60, is also connected with motor 18', motor 20', motor 24', motor 26', motor 36', motor 42', and motor 54.

In operation, fibers from two sources are fed through fed chutes 12 into mixing chamber 22. The relative peripheral speeds of feed rolls 18 and 20 are set at predetermined rates. Control 60 provides signals which control motors 18' and 20' to at selected speed.

The opened and blended fibers are moved from the mixing chamber by combing roll 24 and beater roll 26 into receiving end 28 of batt forming chute 30. The combing roll and beater are driven at a selected speed by motors 24' and 26' which are under the control of control 60. Packing belt 42 and vibrating plate 36 assist in moving the free falling fibers down batt forming chute 30 forming a fiber batt in the lower portion thereof. Motors 36' and 42', also underthe control of control 60, move the packing belt and vibrating plate at desired and relative speeds.

The fiber volume within baft forming chute 40 is constantly monitored by sensor 56. A sensing of other than the desired fiber volume causes sensor 56 to signal control 60 of the deficiency. Control 60 responds by causing motors 18' and 20' or motors 18', 20', and 26' to increase or decrease their RPM's within selected limits to increase or decrease the fiber input. In this manner the fiber volume in batt forming chute 40 is maintained at the desired level.

As the formed fiber batt emerges from delivery end 40 and is compressed by compression roll 46, the position of roll 46 in slot 58 is sensed by sensor 58' which sends a signal to control 60. Control 60 determine the density of the fiber batt compares that density against a norm and causes motors 36' and 42' to increase or decrease their RPM's as dictated by the density comparisons. In this arrangement, it is sometimes desirable to only control motor 42' to vary its RPM's.

Alternatively, compression roll 46 may not be equipped with a sensing arrangement. In this event, scale 52 is arranged to cooperate with conveyor belt 50 as the fiber batt is delivered to further processing. As the fiber batt is being passed over conveyor belt 50 scale 52 weights the fiber batt and signals control 60. Control 60, in response to that sensing determines the fiber batt density, compares that density with a norm, and signals motors 36' and 42' or just motor 42' to adjacent RPM's accordingly.

Normally, only one of compression roll 46 or conveyor belt 50 is provided with a sensing device. While a preferred embodiment of the invention has been described using specific terms, such description is for illustrative purposes only, and it is to be understood that changes and variations may be made without departing from the spirit or scope of the following claims.

What is claimed is:

1. Apparatus for forming a non-woven fiber batt of fibrous material comprising;

a feed having a plurality of feed chutes for feeding fibers from a plurality of sources;

a housing connecting with discharge ends of said feed chutes, said housing having an exit opening which delivers said fibers into a fiber batt forming chute;

said housing having a feed roll adjacent each said discharge end of said feed chutes and independent drive motors driven at selected RPMs for each said feed roll said feed rolls acting to withdraw said fibers from said feed chutes in selected volumes and to deliver said fibers into a mixing chamber;

a combing roll within said housing, driven at RPM's greater than said feed rolls acting to move said fibers from said mixing chamber onto a beater roll which moves said fibers through a beater chamber; wherein, said fibers are further blended and opened during delivery to further processing.

2. The fiber batt forming apparatus of claim 1; including an independent drive motor for said beater roll, said beater roll drive motor driving said beater roll at greater RPM's than said feed rolls are driven.

3. The fiber batt forming apparatus of claim 2; including a control capable of controlling said independent feed roll and beater roll drive motors at selected RPM is driving said feed and beater rools at selected peripheral speeds.

4. The fiber batt forming apparatus of claim 2; wherein there is a first feed roll adjacent said comber roll and second feed roll adjacent said feed roll adjacent said beater roll, said first feed roll having a smaller diameter than said second feed roll.

5. The fiber batt forming apparatus of claim 1; wherein said feed rolls, said combing rolls and said beater rolls each have protruding teeth forming their outer surfaces.

6. The fiber batt of forming apparatus of claim 5; wherein said surface forming teeth of at least said larger diameter feed roll form a helical bite.

7. The fiber baft forming apparatus of claim 1; wherein said further processing includes a fiber batt forming chute receiving said mixed fibers from said beater chamber and forming a fiber batt therefrom, said batt forming chute having upper and lower wall surfaces, a delivery end and a packing belt, said packing belt extending from the vicinity of said beater chamber toward said delivery end forming at least a portion of one of said upper and lower walls.

8. The fiber batt of forming apparatus of claim 7; including an independent drive motor driving said packing belt, said packing belt drive motor driving said packing belt at selected speed in the direction of said delivery end.

9. The fiber batt forming apparatus of claim 7; including a vibrating plate forming at least a portion of the other of said upper and lower walls and an independent drive driving said vibrating plate.

10. The fiber batt forming apparatus of claim 9; including a compression roll adjacent the deliver end of said batt forming chutes, said compression roll acting to further compress said fibers forming said fiber batt against a delivery surface during delivery from said batt forming chute.

11. The fiber batt forming apparatus of claim 10; including a compression roll mounting structure, said compression roll mounting structure permitting movement of said compression roll relative said delivery surface dependent upon the density of said fiber batt emerging from said delivery end and a control capable of varying the operational speed of at least one of said packing belt and said vibrating plate dependent on the position of said compression roll as located by the density of said fiber baft.

12. The fiber batt of claim 7; including a conveyor receiving said fiber batt emerging from said fiber batt forming chute, said conveyor including a scale for weighing said fiber batt during delivery from said fiber batt forming chute.

13. The fiber batt forming apparatus of claim 12; including a control for controlling the operational speed of at least one of said packing belt and said vibrating plate.

14. The fiber batt forming apparatus of claim 7; wherein said batt forming chute includes a sensor, said sensor detecting an absence of and an excess of fibers in said batt forming chute, said sensor being connected with at least one of said feed roll, said comber roll and said beater roll for adjusting the peripheral speed thereof in dependance upon the sensing.

15. An apparatus for forming a fiber batt including a fiber batt forming chute comprising:

a receiving end receiving fibers from a supply, a delivery end delivering a formed fiber batt for further processing and a first and a second wall interconnecting with said receiving and delivery ends for containing said fibers during formation into said fiber batt;

a pair of side walls spacing said first and second walls and interconnecting with said receiving end and said delivery end;

a vibrating assembly including a drive motor forming at least a portion of said second wall;

a packing belt forming at least a portion of said first wall; and, a packing belt drive motor and a control controlling said packing belt drive motor for driving said packing belt in the direction of said delivery end at a prescribed speed dependent upon the density of said fiber batt leaving said delivery end; and, a control for controlling the speed of said packing belt drive motor in dependence upon the density of said fiber batt leaving said delivery end; and, said second wall includes a vibrating assembly including a vibrating assembly drive motor.

16. The forming apparatus of claim 15; wherein said control further controls the speed of said vibrating drive in dependence upon the density of said fiber batt emerging from said delivery end.

17. The apparatus of claim 16; including a sensor in said fiber batt forming chutes, said sensor sensing the volume of fibers within said batt forming chute and said sensor being operate to signal said control upon sensing fiber volume outside set limits.

18. The apparatus of claim 17; wherein said control is operative to vary the volume of fibers received within said batt forming chute by varying the volume of fibers delivered from said supply in dependence upon said signal.

19. The apparatus of claim 15; further including a compression roll assembly acting to compress and feed said fiber batt onto a conveyor assembly for movement away from said batt forming chute.

20. The apparatus of claim 19; wherein said compression roll assembly includes a sensor for sensing the position of said compression roll within said compression roll assembly, said sensor being operative to signal a control to vary the speed of the drive of at least one of the packing belt and the vibrator.

21. The apparatus of claim 15; wherein said conveyor assembly includes a scale for determining the weight of said fiber batt, said scale being operative signal a control to vary the speed of the drive of at least one of the packing belt and the vibrator in dependence upon the weight of fiber batt.

* * * * *